US006725677B2

(12) United States Patent
Taira

(10) Patent No.: US 6,725,677 B2
(45) Date of Patent: Apr. 27, 2004

(54) REFRIGERATOR, ABRASIVE POWDER JUDGING DEVICE, AND REFRIGERANT OXIDATION JUDGING DEVICE

(75) Inventor: Shigeharu Taira, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/203,756

(22) PCT Filed: Jan. 31, 2001

(86) PCT No.: PCT/JP01/00621

§ 371 (c)(1),
(2), (4) Date: Aug. 12, 2002

(87) PCT Pub. No.: WO01/59375

PCT Pub. Date: Aug. 16, 2001

(65) Prior Publication Data

US 2003/0010044 A1 Jan. 16, 2003

(30) Foreign Application Priority Data

Feb. 14, 2000 (JP) ..... 2000-034948

(51) Int. Cl.[7] ..... F25B 49/00; G01K 13/00
(52) U.S. Cl. ..... 62/127; 62/129
(58) Field of Search ..... 62/127, 129, 195, 62/85, 475

(56) References Cited

U.S. PATENT DOCUMENTS 4,923,806 A * 5/1990 Klodowski ..... 436/39
5,071,768 A * 12/1991 Klodowski ..... 436/39
5,846,833 A * 12/1998 Clough et al. ..... 436/139
5,865,607 A * 2/1999 Fukuoka ..... 418/46
6,250,898 B1 * 6/2001 Fukuoka ..... 418/46
6,510,698 B2 * 1/2003 Kasai et al. ..... 62/77

FOREIGN PATENT DOCUMENTS

| | | |
|---|---|---|
| JP | 5-71829 A | 3/1993 |
| JP | 7-19677 | 1/1995 |
| JP | 7-19680 A | 1/1995 |
| JP | 8-110101 A | 4/1996 |
| JP | 9-145209 | 6/1997 |
| JP | 9-318204 A | 12/1997 |
| JP | 10-89812 | 4/1998 |
| JP | 10-311628 | 11/1998 |
| JP | 11-132607 | 5/1999 |
| JP | 11-223431 A | 8/1999 |

* cited by examiner

*Primary Examiner*—Marc Norman
(74) *Attorney, Agent, or Firm*—Birch, Stewart, Kolasch & Birch, LLP

(57) ABSTRACT

A refrigerator, comprising an oil deterioration judging device for judging a degree of deterioration of a refrigerating machine oil, wherein the oil deterioration of a refrigerating machine oil, wherein the oil deterioration judging device is disposed between a discharge side of a compressor and a gas closing valve, between a four-way directional control valve and the gas closing valve, or in a middle of a gas side connecting pipe.

12 Claims, 4 Drawing Sheets

REFRIGERATOR, ABRASIVE POWDER JUDGING DEVICE, AND REFRIGERANT OXIDATION JUDGING DEVICE

This application is a national phase under 35 U.S.C. §371 of PCT International Application No. PCT/JP01/00621 which has an International filing data of Jan. 31, 2001, which designated the United States America.

TECHNICAL FIELD

The present invention relates to a refrigerator, abrasive powder judging device and refrigerant oxidation judging device.

BACKGROUND ART

In a heat pump type refrigerator using a refrigerant, HFC refrigerants having the zero Ozone Depletion Potential are used as alternatives to HCFC refrigerants since the HCFC refrigerants having a high Ozone Depletion Potential have become a target of CFC gas regulations. In the refrigerator using this HFC refrigerant, mutual solubility between a refrigerating machine oil and the HFC refrigerant is one of important characteristics. Therefore, a synthetic oil such as an ether oil or ester oil is used as the refrigerating machine oil. However, the synthetic oil easily dissolves residual impurities that are not the refrigerating machine oil or the refrigerant because the synthetic oil has strong polarity. Therefore, there are problems of blocking by sludge or the like and initial defects after evaporation of the refrigerant in a depressurizing mechanism constituted by a motor-operated expansion valve. Hence, abnormality occurs in a refrigerating cycle, thereby deteriorating reliability.

Furthermore, there is no means for judging the amount of an abrasive powder discharged from a compressor or the like into a refrigerant circuit in the refrigerator. Therefore, the time when the abrasive powder should be removed cannot be determined. As a result, blocking by the abrasive powder and initial defects occur in the depressurizing mechanism constituted by the motor-operated expansion valve, and thereby there is a problem that reliability of the refrigerator cannot be secured for a long period.

Furthermore, there is another problem in the refrigerator that, since there is no means for judging the amount of decomposition products (toxic substances such as hydrofluoric acid, phosgene and so forth) generated due to refrigerant oxidation, the time when a deteriorated refrigerant should be replaced cannot be determined, and thereby reliability of the refrigerator cannot be secured for a long period.

DISCLOSURE OF INVENTION

An object of the present invention is to provide a refrigerator in which the degree of deterioration of a refrigerating machine oil can be judged with a simple structure, thereby blocking in a depressurizing mechanism is prevented, and reliability of the refrigerator can be maintained for a long period.

Furthermore, another object of the present invention is to provide an abrasive powder judging device with which the amount of an abrasive powder in a refrigerant circuit can be judged with a simple structure, and thereby blocking of a depressurizing mechanism is prevented, and reliability of a refrigerator or the like can be maintained for a long period.

Furthermore, yet another object of the present invention is to provide a refrigerant oxidation judging device with which the degree of oxidation of a refrigerant can be judged with a simple structure, and reliability of a refrigerator or the like can be maintained for a long period.

In order to achieve the above objects, the present invention provides a refrigerator comprising an oil deterioration judging device for judging a degree of deterioration of a refrigerating machine oil, wherein the oil deterioration judging device is disposed between a discharge side of a compressor and a gas closing valve, between a four-way directional control valve and the gas closing valve, or in a middle of a gas side connecting pipe.

According to the refrigerator having the above constitution, since a gas refrigerant containing much refrigerating machine oil is discharged from the compressor into a gas side pipe, the oil deterioration judging device is disposed between the discharge side of the compressor and the gas closing valve or between the four-way directional control valve and the gas closing valve (in a pipe that is on the gas side at the time of a heating operation). By the oil deterioration judging device, the degree of oil deterioration can be easily judged, and the degree of deterioration of the refrigerating machine oil can be judged with a simple structure. Based on the judgment result, a working medium (the refrigerant containing the refrigerating machine oil) is replaced as required, and thereby blocking of the depressurizing mechanism or the like can be prevented. Thus, reliability of the refrigerating machine can be maintained for a long period.

Furthermore, the refrigerator of the present invention is equipped with an oil deterioration judging device for judging the degree of deterioration of the refrigerating machine oil disposed in the gas side connecting pipe.

According to the refrigerator having the above constitution, since a gas refrigerant containing much refrigerating machine oil is discharged from the compressor into the gas side connecting pipe in a split type including an outdoor unit and an indoor unit, the oil deterioration judging device is attached to a connecting pipe, which is on the gas side at the time of a heating operation, among connecting pipes for connecting the outdoor unit and the indoor unit. By the oil deterioration judging device, the degree of oil deterioration can be easily judged, and the degree of deterioration of the refrigerating machine oil can be judged with a simple structure. Based on the judgment result, a working medium (the refrigerant containing the refrigerating machine oil) is replaced as required. Thereby, reliability of the refrigerating machine can be maintained for a long period. Furthermore, the present invention can be applied with a simple structure without changing the design of the outdoor unit and the indoor unit. The present invention can also be applied easily in an existing air conditioner by replacing its connecting pipe with the connecting pipe equipped with the oil deterioration judging device.

In the refrigerator according one embodiment of the present invention, an HFC refrigerant is used.

According to the refrigerator of the above embodiment, since a synthetic oil such as an ether oil, ester oil or the like has strong polarity, which synthetic oil is used as a refrigerating machine oil having mutual solubility with the HFC refrigerant, it easily dissolve residual impurities that are not the refrigerating machine oil or the refrigerant. Therefore, blocking with sludge or initial defects are easily generated in the depressurizing mechanism constituted by a motor-operated expansion valve. However, by early detection of deterioration of the refrigerating machine oil with use of the oil deterioration judging device, measures such as replacement of the refrigerant containing the refrigerating machine oil or the like can be taken before trouble occurs.

In the refrigerator according one embodiment of the present invention, an R32 refrigerant or a mixed refrigerant containing at least 70 weight % or more of R32 is used.

According to the refrigerator of the above embodiment, since a synthetic oil such as an ether oil, ester oil or the like has strong polarity, which synthetic oil is used as a refrigerating machine oil having mutual solubility with the an R32 refrigerant or a mixed refrigerant containing at least 70 weight % or more of R32, it easily dissolve residual impurities that are not the refrigerating machine oil or the refrigerant. Therefore, blocking with sludge or initial defects are easily generated in the depressurizing mechanism constituted by a motor-operated expansion valve. However, by early detection of deterioration of the refrigerating machine oil with use of the oil deterioration judging device, measures such as replacement of the refrigerant containing the refrigerating machine oil or the like can be taken before trouble occurs.

In the refrigerator according one embodiment of the present invention, a simple judging unit is included in the oil deterioration judging device.

According to the refrigerator of the above embodiment, the oil deterioration judging device includes for example coating with a chemical substance that changes its color in response to moisture, and has a simple judging unit for judging the degree of moisture content by is comparing with the color of the chemical substance. Thereby, the degree of oil deterioration can be easily judged.

In the refrigerator according one embodiment of the present invention, the oil deterioration judging device includes a simple judging unit coated with a pigment with which oil oxidation can be judged.

According to the refrigerator of the above embodiment, the degree of oil oxidation is judged by a color of the simple judging unit coated with the pigment that changes its color depending on the degree of oil oxidation. In the case of for example a pH indicator as the pigment, the degree of oil oxidation can be easily judged by the change of the color of the pH indicator.

In the refrigerator according one embodiment of the present invention, a judgment table for judging a degree of oil oxidation is included.

According to the refrigerator of the above embodiment, the degree of oil deterioration can be easily judged at site by using the judgment table for judgement under comparison with the color of the pigment.

The present invention also provides an abrasive powder judging device comprising a magnet with which an amount of an abrasive powder in a refrigerant circuit is judged.

According to the abrasive powder judging device having the above constitution, the degree of the amount of the abrasive powder contained in the refrigerant can be judged by the amount of abrasive powder attached to the magnet. Therefore, the degree of the abrasive powder in the refrigerant circuit can be judged with a simple structure. Based on the judgment result, a working medium (the refrigerant containing the refrigerating machine oil) is replaced as required. Thereby, blocking of the depressurizing mechanism or the like can be prevented. Thus, reliability of the refrigerating machine can be maintained for a long period.

In the refrigerator according one embodiment of the present invention, a judgment table for judging the amount of the abrasive powder is included.

According to the abrasive powder judging device of the above embodiment, the degree of the amount of the abrasive powder contained in the refrigerant can be easily judged at site by using the judgment table for judgement under comparison with the amount of the abrasive powder attached to the magnet.

The present invention provides a refrigerator comprising the above abrasive powder judging device, According to the refrigerator having the above constitution, the amount of the abrasive powder contained in the refrigerant circuit is judged by the abrasive powder judging device. Based on the judgment result, the abrasive powder is removed as required. Thus, reliability of the refrigerator can be maintained for a long period.

The present invention provides a refrigerant oxidation judging device comprising a simple judging unit coated with a pigment with which refrigerant oxidation is judged.

According to the refrigerant oxidation judging device having the above constitution, the degree of refrigerant oxidation is judged by the color of the simple judging unit coated with a pigment that changes its color depending on the degree of refrigerant oxidation. By using, for example, a pH indicator as the pigment, the degree of oxidation of the refrigerant can be easily judged by the change of the color of the pH indicator. Therefore, the degree of oxidation of the refrigerant can be judged with a simple structure. Based on the judgment result, a working medium (the refrigerant containing the refrigerating machine oil) is replaced as required, and thereby occurrence of trouble due to a toxic substance, which is a decomposition product of the refrigerant, can be prevented. Thus, reliability of the refrigerating machine can be maintained for a long period.

In the refrigerator according one embodiment of the present invention, a judgment table is included for judging a degree of refrigerant oxidation.

According to the refrigerant oxidation judging device having the above constitution, the degree of refrigerant deterioration can be easily judged at site by using the judgment table for judgement under comparison with the color of the pigment.

The present invention provides a refrigerator comprising the refrigerant oxidation judging device according to claim 10.

According to the refrigerator having the above constitution, the degree of oxidation of the refrigerant is judged by the refrigerant oxidation judging device. Based on the judgment result, a working medium (the refrigerant containing the refrigerating machine oil) is replaced as required. Thereby, hydrofluoric acid, phosgene or the like, which is a decomposition product of the refrigerant, can be removed. Thus, reliability of the refrigerating machine can be maintained for a long period.

BEST MODE FOR CARRYING OUT THE INVENTION

Hereafter, refrigerators according to the present invention are described in detail with reference to accompanying drawings.

First Embodiment

Figure 1:
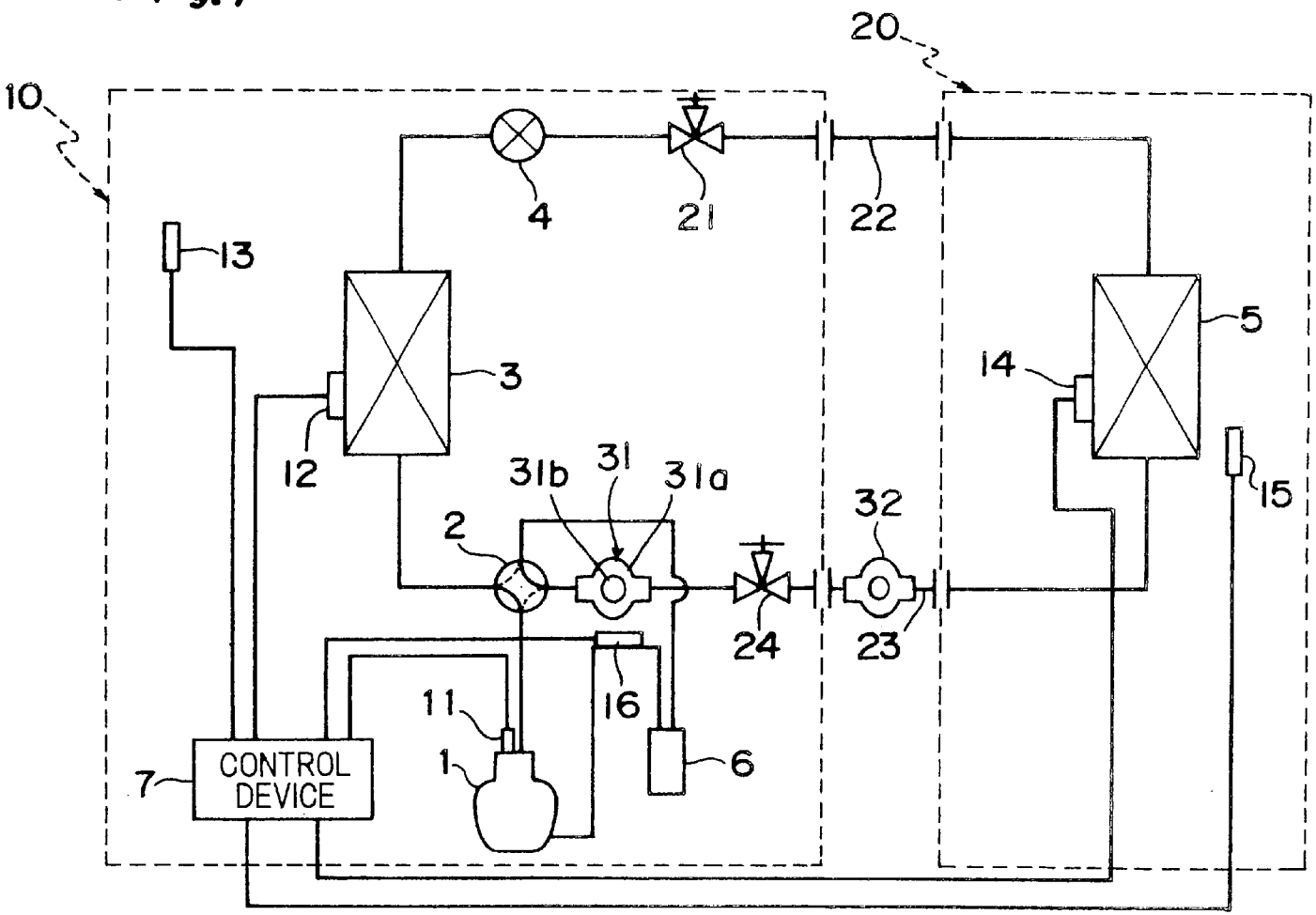
FIG. 1 is a circuit diagram of a refrigerator according to a first embodiment of the invention.

FIG. 1 is a circuit diagram showing a schematic constitution of a heat pump type air conditioner as a refrigerator according to a first embodiment of the present invention. Reference numeral 1 denotes a compressor. Reference numeral 2 denotes a four-way directional control valve, one end of which is connected to the discharge side of the compressor 1. Reference numeral 3 denotes an outdoor heat exchanger, one end of which is connected to the other end of the four-way directional control valve 2. Reference numeral 4 denotes a motor-operated expansion valve, one end of which is connected to the other end of the outdoor heat exchanger 3. Reference numeral 5 denotes an indoor heat exchanger, one end of which is connected to the other end of the motor-operated expansion valve 4. Reference numeral 6 denotes an accumulator, one end of which is connected to the other end of the indoor heat exchanger 5 via the four-way directional control valve 2, and the other end of which is connected to the suction side of the compressor 1.

Furthermore, the air conditioner includes a temperature sensor 11 for detecting discharge pipe temperature of the compressor 1, temperature sensor 12 for detecting refrigerant temperature of the outdoor heat exchanger 3, temperature sensor 13 for detecting outside air temperature, temperature sensor 14 for detecting refrigerant temperature of the indoor heat exchanger 5, temperature sensor 15 for detecting indoor temperature, temperature sensor 16 for detecting refrigerant temperature on the suction side of the compressor 1, and control device 7 which receives signals from the temperature sensors 11–16 and controls the compressor 1, motor-operated expansion valve 4 and so forth. Furthermore, a closing valve 21 is disposed between the motor-operated expansion valve 4 and the indoor heat exchanger 5, and a closing valve 24 is disposed between the indoor heat exchanger 5 and the four-way directional control valve 2. An oil deterioration judging device 31 is disposed between the four-way directional control valve 2 and the closing valve 24 which is on the gas side at the time of a heating operation.

An outdoor unit 10 is constituted by the compressor 1, the four-way directional control valve 2, the outdoor heat exchanger 3, the motor-operated expansion valve 4, the accumulator 6, the control device 7, the closing valve 21, the closing valve 24, the temperature sensors 11–13, the temperature sensor 16 and an outdoor fan (not shown). An indoor unit 20 is constituted by the indoor heat exchanger 5, the temperature sensor 14, the temperature sensor 15 and an indoor fan (not shown).

The oil deterioration judging device 31 includes a sight glass i.e. a window glass 31*b* formed in a container body 31*a* connected to pipes at both ends, as shown in FIG. 1. The degree of oil deterioration is visually judged by observing the inside of the container body 31*a* through the window glass 31*b*, specifically, by observing blackened resin-like composites or polymers such as sludge attached to the inside of the window glass 31*b*.

FIGS. 4A–4D show judgment tables provided in the oil deterioration judging device 31.

Figure 4A:
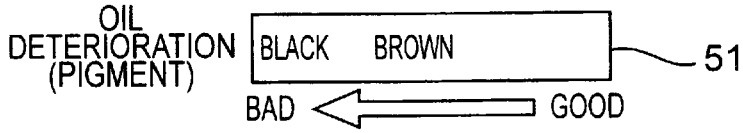
FIGS. 4A–4E are views each showing a judgment table used for a simple judging unit.

With reference to FIG. 4A, the degree of oil deterioration is judged by comparing a color of oil attached to the inside of the window glass 31*b* and colors in the judgment table 51. For example, as the color of the oil attached to the window glass 31*b* is changed from brown to black, the oil is so deteriorated.

Figure 4B:
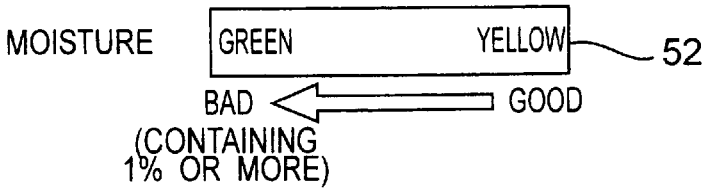

With reference to FIG. 4B, a chemical substance (such as cobalt), which changes its color depending on the moisture content rate, is applied to a position that can be seen through the window glass 31*b* in the container body 31*a*, and thereafter the degree of moisture content is judged by comparing a color of the applied chemical substance and colors in the judgment table 52. For example, as the color of the chemical substance is changed from yellow to green, the moisture content rate is so increased, which shows that the oil is deteriorated.

Figure 4C:
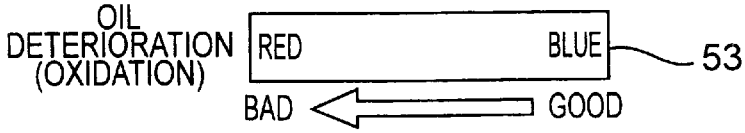

With reference to FIG. 4C, pigment of a pH indicator or the like that changes its color depending on the degree of oil oxidation is applied to a position that can be seen through the window glass 31*b* in the container body 31*a*, and thereafter the degree of oil deterioration is judged by comparing a color of the applied pigment and colors in the judgment table 53. For example, as the color of the pigment is changed from blue to red, the degree of oxidation is so increased, which shows that the oil is deteriorated.

Figure 4D:
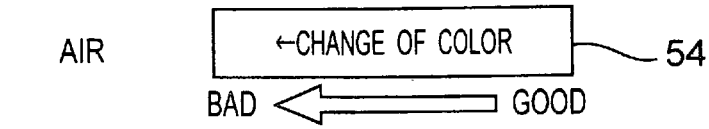

With reference to FIG. 4D, a chemical substance that changes its color depending on the air content rate is applied to a position that can be seen through the window glass 31*b* in the container body 31*a*, and thereafter the degree of air content is judged by comparing a color of the applied chemical substance and colors in the judgment table 54. For example, it is shown that the air content rate is increased along with the change of the color of the chemical substance.

Figure 5:
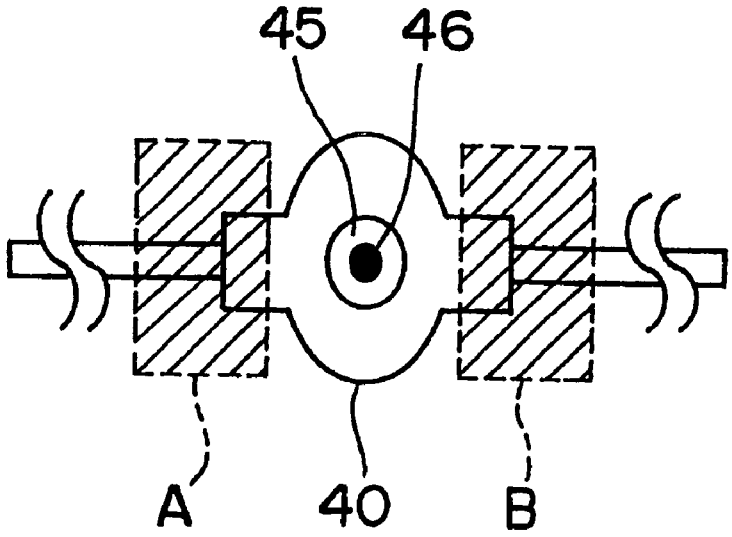
FIG. 5 is a view showing a position at which the judgment table is pasted.

The judgment tables 51–54 shown in FIGS. 4A–4D are pasted in the vicinity of both ends of the container body 40 as shown in FIG. 5. FIG. 5 shows the window glass 45 and a simple judging unit 46 (the applied chemical substance, fixed magnet or the like) that can be seen through the window glass 45.

In the air conditioner having the above constitution, the gas refrigerant containing much refrigerating machine oil is discharged into the gas side pipe. The degree of oil deterioration can be easily judged by using the oil deterioration judging device 31 fixed in the gas side pipe that is on the gas side at the time of a heating operation.

Thus, the degree of deterioration of the refrigerating machine oil can be judged with a simple structure. Based on the judgment result, a working medium (i.e. the refrigerant containing refrigerating machine oil) is replaced as required, and thereby reliability of the refrigerating machine can be maintained for a long period.

Furthermore, the degree of oil deterioration can be easily at site by disposing the judgment tables 51–54 in the vicinity of the container body 31*a*.

Second Embodiment

Figure 2:
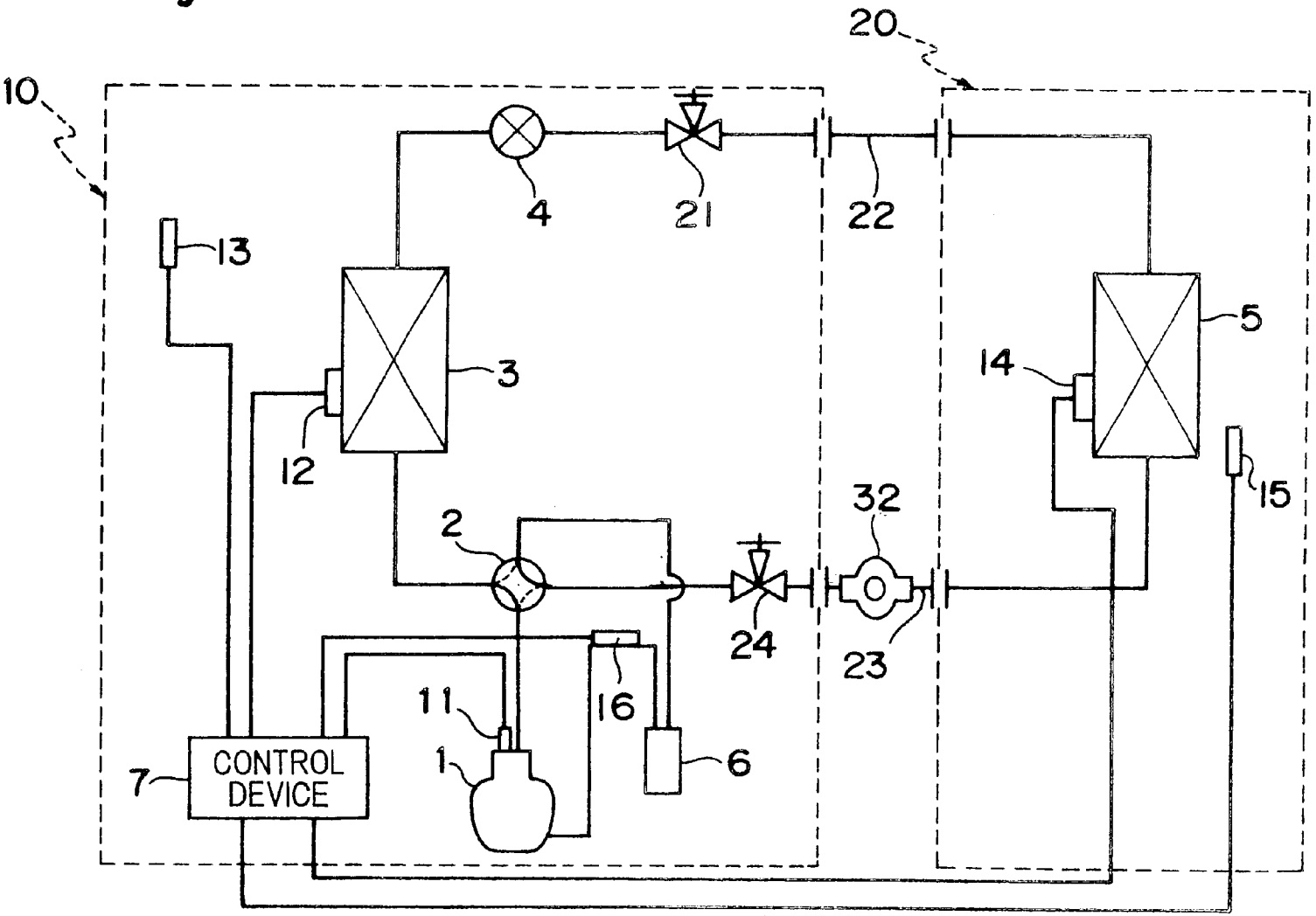
FIG. 2 is a circuit diagram of a refrigerator according to a second embodiment of the invention.

FIG. 2 is a circuit diagram showing a schematic constitution of a heat pump type air conditioner as a refrigerator according to a second embodiment of the present invention. Except for an oil deterioration judging device, the constitution is the same as that of the air conditioner of the first embodiment. The same component members as those of the first embodiment are designated by the same reference numerals and their explanation is omitted. In this air conditioner, as shown in FIG. 2, an oil deterioration judging device 32 is disposed in a connecting pipe 23 that are on the gas side at the time of a heating operation.

Figure 3:
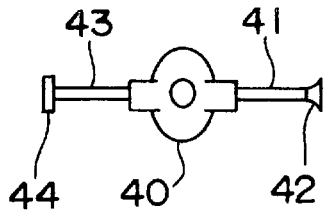
FIG. 3 is a schematic view showing an oil deterioration judging device to be disposed in a connecting pipe of the above refrigerators.

FIG. 3 shows a connecting pipe in which the oil deterioration judging device is disposed. One end of the oil deterioration judging device 40 is connected to one end of a pipe 41, and the other end of the pipe 41 may be connected to the outdoor unit or the indoor unit through a flare groove joint. Besides, the other end of the oil deterioration judging device 40 is connected to one end of a pipe 43, and the other end of the pipe 43 may be connected to the outdoor unit or the indoor unit through a high-pressure joint (the swedge lock, double lock or the like).

In the case of this second embodiment as in the case of the first embodiment, the degree of deterioration of the refrigerating machine oil can be also judged with a simple structure. Based on the judgment result, a working medium (the refrigerant containing the refrigerating machine oil) is replaced as required, and thereby reliability of the refrigerating machine can be maintained for a long period. Furthermore, the present invention can be applied with a simple structure without changing the design of the outdoor unit and the indoor unit, and also the present invention can be easily applied in an existing air conditioner by replacing its connecting pipe with a connecting pipe having the oil deterioration judging device.

In the first and second embodiments, there is used the R32 refrigerant or the mixed refrigerant containing at least 70 weight % or more of R32 as the HFC refrigerant. However, a mixed refrigerant of the R32 refrigerant and $CO_2$ may be used in which the R32 refrigerant is contained between 70 weight % and 90 weight % inclusive to $CO_2$. A mixed refrigerant of the R32 refrigerant and the R22 refrigerant may be used in which the R32 refrigerant is contained between 70 weight % and 90 weight % inclusive to the R22 refrigerant.

Figure 4E:
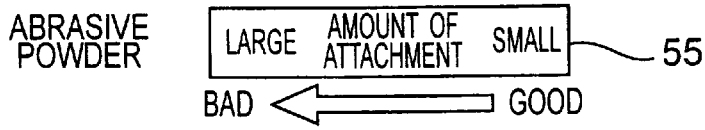

In the first and second embodiments, the air conditioner is explained as a refrigerator equipped with an oil deterioration judging device 31. However, apart from the oil deterioration judging device, an abrasive powder judging device may be included. In this abrasive powder judging device, a magnet is embedded at a position that can be seen through a window glass 31*b* in the container body 31*a* (shown in FIG. 1). The degree of the abrasive powder content is judged by comparing a color of the abrasive powder attached to the magnet and colors in a judgment table 55 (shown in FIG. 4E) For example, the more the amount of the attached abrasive powder is, the darker the color becomes. Thereby, it is shown that much abrasive powder is attached. In this case, the degree of the amount of the abrasive powder contained in the refrigerant can be judged from the amount of the abrasive powder attached to the magnet. Therefore, the degree of the abrasive powder in the refrigerant circuit can be judged with a simple structure. Based on the judgment result, a working medium (the refrigerant containing the refrigerating machine oil) is replaced as required, and thereby blocking of the depressurizing mechanism or the like can be prevented. Thus, reliability of the refrigerating machine can be maintained for a long period. Furthermore, the degree of refrigerant deterioration can be easily judged at site by providing the judgment table 55 in the vicinity of the container body 31*a*.

Furthermore, a refrigerant oxidation judging device may be included apart from the oil deterioration judging device and the abrasive powder judging device. In the refrigerant oxidation judging device, a pigment of a pH indicator or the like, which changes its color depending on the degree of refrigerant oxidation, is applied to a position that can be seen though the window glass 31*b* in the container body 31*a* (shown in FIG. 1). The degree of refrigerant oxidation is judged by comparing a color of the applied pigment and colors in the judgment table (the same as shown in FIG. 4C). In this case, there can be judged the amount of a toxic substance such as hydrofluoric acid which is a decomposition product of the HFC refrigerant, phosgene which is a decomposition product of the HCFC refrigerant, or the like. Based on the judgment result, a working medium (the refrigerant containing the refrigerating machine oil) is replaced as required, and thereby deterioration of various portions due to the toxic substance can be prevented. Thus, reliability of the refrigerating machine can be maintained for a long period. Furthermore, the degree of refrigerant deterioration can be easily judged at site by providing the judgment table in the vicinity of the container body 31*a*.

What is claimed is:

1. A refrigerator comprising an oil deterioration judging device for judging a degree of deterioration of a refrigerating machine oil, wherein the oil deterioration judging device is disposed between a discharge side of a compressor and a gas closing valve, between a four-way directional control valve and the gas closing valve, or in a middle of a gas side connecting pipe.

2. The refrigerator according to claim 1, wherein an HFC refrigerant is used.

3. The refrigerator according to claim 1, wherein an R32 refrigerant or a mixed refrigerant containing at least 70 weight % or more of R32 is used.

4. The refrigerator according to claim 1, wherein a simple judging unit is included in the oil deterioration judging device.

5. The refrigerator according to claim 1, wherein the oil deterioration judging device includes a simple judging unit coated with a pigment with which oil oxidation can be judged.

6. The refrigerator according to claim 5, wherein a judgment table for judging a degree of oil oxidation is included.

7. An abrasive powder judging device comprising a magnet with which an amount of an abrasive powder in a refrigerant circuit is judged.

8. The abrasive powder judging device according to claim 7, wherein a judgment table for judging the amount of the abrasive powder is included.

9. A refrigerator comprising the abrasive powder judging device according to claim 7.

10. A refrigerant oxidation judging device comprising a simple judging unit coated with a pigment with which refrigerant oxidation is judged.

11. The refrigerant oxidation judging device according to claim 10, wherein a judgment table is included for judging a degree of refrigerant oxidation.

12. A refrigerator comprising the refrigerant oxidation judging device according to claim 10.

* * * * *

UNITED STATES PATENT AND TRADEMARK OFFICE

CERTIFICATE OF CORRECTION

PATENT NO. : 6,725,677 B2
DATED : April 27, 2004
INVENTOR(S) : Taira

It is certified that error appears in the above-identified patent and that said Letters Patent is hereby corrected as shown below:

Title page,
Item [86], PCT No., change the §371 (c) (1), (2), (4) date from "Aug. 12, 2002" to -- Aug. 13, 2002 --.

Signed and Sealed this

Twenty-eighth Day of September, 2004

JON W. DUDAS
*Director of the United States Patent and Trademark Office*